US008926273B2

(12) United States Patent
Baran et al.

(10) Patent No.: US 8,926,273 B2
(45) Date of Patent: Jan. 6, 2015

(54) STEAM TURBINE WITH SINGLE SHELL CASING, DRUM ROTOR, AND INDIVIDUAL NOZZLE RINGS

(75) Inventors: Robert Gerard Baran, Clifton Park, NY (US); Kenneth Michael Koza, Ballston Lake, NY (US); Richard James Miller, Jr., Round Lake, NY (US); James Edward Olson, Mechanicville, NY (US); Robert James Piechota, Albany, NY (US); Kevin John Lewis Roy, Clifton Park, NY (US); Fred Thomas Willett, Burnt Hills, NY (US)

(73) Assignee: General Electric Company, Schenectady, NY (US)

( * ) Notice: Subject to any disclaimer, the term of this patent is extended or adjusted under 35 U.S.C. 154(b) by 415 days.

(21) Appl. No.: 13/362,329

(22) Filed: Jan. 31, 2012

(65) Prior Publication Data

US 2013/0195644 A1 Aug. 1, 2013

(51) Int. Cl.
*F01D 25/24* (2006.01)
*F04D 29/00* (2006.01)

(52) U.S. Cl.
USPC ..... 415/182.1; 415/219.1

(58) Field of Classification Search
CPC ..... F01D 1/00; F01D 1/04; F01D 11/00; F01D 25/24
USPC ..... 415/108, 126, 182.1, 213.1, 219.1; 416/174
See application file for complete search history.

(56) References Cited

U.S. PATENT DOCUMENTS

| | | | | |
|---|---|---|---|---|
| 3,498,062 | A * | 3/1970 | Daltry | 60/688 |
| 4,653,277 | A * | 3/1987 | Bozec | 60/692 |
| 4,710,103 | A | 12/1987 | Faber et al. | |
| 4,866,941 | A * | 9/1989 | Stock | 60/692 |
| 4,961,310 | A | 10/1990 | Moore et al. | |
| 5,411,365 | A * | 5/1995 | Mazzola et al. | 415/93 |
| 6,843,479 | B2 | 1/2005 | Burdgick | |
| 7,186,074 | B2 | 3/2007 | Blatchford et al. | |
| 7,267,525 | B2 | 9/2007 | Hiegemann et al. | |
| 7,387,486 | B2 | 6/2008 | Blatchford et al. | |
| 7,390,160 | B2 | 6/2008 | Blatchford et al. | |
| 2004/0021273 | A1 | 2/2004 | Burdgick | |
| 2004/0117045 | A1 | 6/2004 | Hovland et al. | |
| 2004/0253100 | A1 | 12/2004 | Blatchford et al. | |

(Continued)

FOREIGN PATENT DOCUMENTS

| | | |
|---|---|---|
| EP | 0566478 B1 | 5/1996 |
| EP | 0566478 B2 | 7/2002 |

(Continued)

*Primary Examiner* — Dwayne J White
*Assistant Examiner* — Brian P Wolcott
(74) *Attorney, Agent, or Firm* — Ernest G. Cusick; Hoffman Warnick LLC

(57) ABSTRACT

A steam turbine with a drum rotor utilizing individual nozzle ring assemblies in the IP section incased by a single shell. In one embodiment, a steam turbine has a high pressure (HP) section with a double shell drum and an intermediate pressure (IP) section with a single shell drum, with the IP section including a plurality of individual nozzle ring assemblies axially spaced along the single shell casing, such that each nozzle ring assembly surrounds the drum rotor. In other embodiments, a low pressure section (LP) of the steam turbine can have a single-flow or dual-flow connection to a condenser, and the condenser can be positioned to the side, vertically below, or axially aligned with the LP section.

13 Claims, 9 Drawing Sheets

(56) References Cited

U.S. PATENT DOCUMENTS

| | | | | |
|---|---|---|---|---|
| 2005/0053462 | A1 | 3/2005 | Burdgick | |
| 2005/0118025 | A1 | 6/2005 | Hiegemann et al. | |
| 2006/0024155 | A1 | 2/2006 | Blatchford et al. | |
| 2006/0024156 | A1* | 2/2006 | Blatchford et al. | 415/170.1 |
| 2009/0022599 | A1* | 1/2009 | Burdgick et al. | 416/230 |
| 2009/0191053 | A1 | 7/2009 | Bridge et al. | |
| 2010/0038917 | A1 | 2/2010 | DiAntonio et al. | |
| 2010/0166557 | A1 | 7/2010 | Howes | |
| 2010/0284792 | A1* | 11/2010 | Ballard et al. | 415/136 |
| 2010/0310356 | A1 | 12/2010 | Swintek | |
| 2011/0085905 | A1 | 4/2011 | Willett et al. | |

FOREIGN PATENT DOCUMENTS

| | | | |
|---|---|---|---|
| EP | 1387039 | A2 | 2/2004 |
| EP | 1429219 | A1 | 6/2004 |
| EP | 1744019 | A1 | 1/2007 |
| EP | 1752614 | A2 | 2/2007 |
| EP | 2204543 | A2 | 7/2010 |
| EP | 2270323 | A2 | 1/2011 |
| EP | 2305364 | A1 | 4/2011 |
| JP | 201043644 | A | 2/2010 |
| JP | 2010281321 | A | 12/2010 |
| WO | 2006100256 | A1 | 9/2006 |
| WO | 2009127523 | A2 | 10/2009 |
| WO | 2011039263 | A1 | 4/2011 |

* cited by examiner

STEAM TURBINE WITH SINGLE SHELL CASING, DRUM ROTOR, AND INDIVIDUAL NOZZLE RINGS

FIELD OF THE INVENTION

Embodiments of the invention relate generally to steam turbines and, more particularly, to a steam turbine having an Intermediate Pressure (IP) section with a single shell casing.

BACKGROUND OF THE INVENTION

Conventional steam turbines use a wheel and diaphragm or drum rotor construction with a traditional double shell casing. While single shell casings have also been used, such applications have been limited to wheel and diaphragm configurations, not drum rotor configurations. In addition, while individual nozzle ring assemblies have been used with IP sections of steam turbines, those IP sections typically have a traditional double shell casing to support the individual nozzle stages. Conventional steam turbines utilizing wheel and diaphragm construction are limited by the pressure limit of the single casing and the manufacture of the diaphragm being limited to a single stage.

BRIEF DESCRIPTION OF THE INVENTION

A steam turbine with a drum rotor utilizing individual nozzle ring assemblies in the IP section encased by a single shell is disclosed herein. In one embodiment, a steam turbine has a high pressure (HP) section with a double shell drum and an intermediate pressure (IP) section with a single shell drum, with the IP section including a plurality of individual nozzle ring assemblies axially spaced along the single shell casing, such that each nozzle ring assembly surrounds the drum rotor. In other embodiments, a low pressure section (LP) of the steam turbine can have a single-flow or dual-flow connection to a condenser, and the condenser can be positioned to the side, vertically below, or axially aligned with the LP section.

A first aspect of the invention provides a steam turbine including an intermediate pressure (IP) section having a single shell casing, wherein the IP section includes: a drum rotor; and a plurality of nozzle ring assemblies axially spaced along the single shell casing, such that each nozzle ring assembly surrounds the drum rotor, and wherein each nozzle ring assembly includes: a supporting ring; and at least one set of individual nozzles coupled to the supporting ring.

A second aspect of the invention provides a steam turbine comprising: a high pressure (HP) section having a double shell casing; an intermediate pressure (IP) section fluidly connected to the HP section, wherein the IP section has a single shell casing, and wherein the IP section includes: a drum rotor; and a plurality of nozzle ring assemblies axially spaced along the single shell casing, such that each nozzle ring assembly surrounds the drum rotor, and wherein each nozzle ring assembly includes: a supporting ring; and at least one set of individual nozzles coupled to the supporting ring; and a low pressure (LP) section fluidly connected to the IP section, wherein the LP section is also connected to a condenser.

BRIEF DESCRIPTION OF THE DRAWINGS

These and other features of embodiments of the invention will be more readily understood from the following detailed description of the various aspects of the invention, taken in conjunction with the accompanying drawings that depict various embodiments of the invention, in which.

It is noted that the drawings are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

A steam turbine having a drum rotor utilizing individual nozzle ring assemblies in the IP section encased by a single shell is disclosed herein. In one embodiment, a steam turbine having a high pressure (HP) section with a double shell drum and an intermediate pressure (IP) section with a single shell drum is disclosed, with the IP section including a plurality of individual nozzle ring assemblies surrounding the drum rotor. In other embodiments, a low pressure section (LP) of the steam turbine can have a single-flow or dual-flow connection to a condenser, and the connection can comprise a side connection, a downward flow connection or an axial connection to the condenser.

Figure 1:
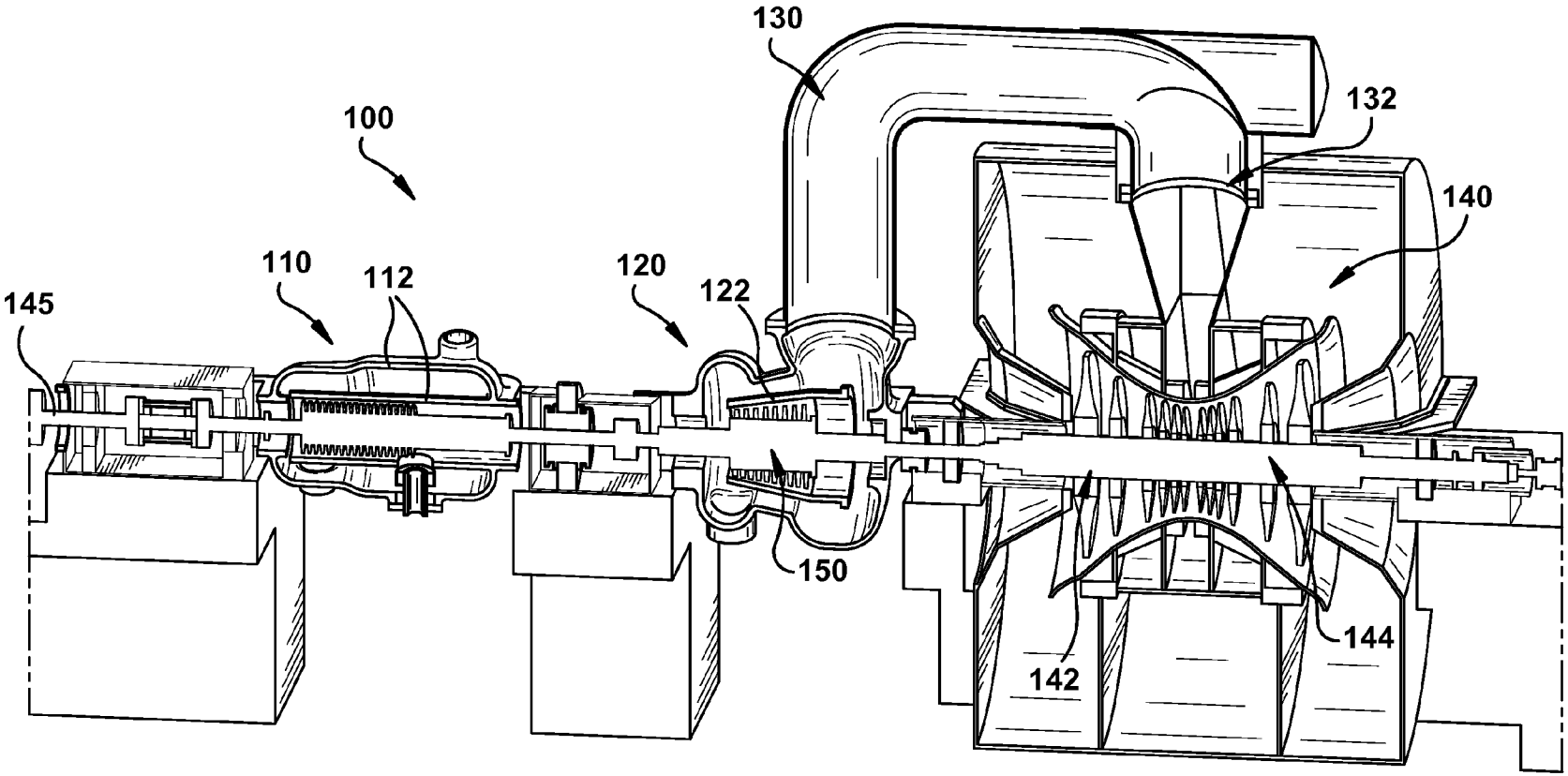
FIG. 1 (PRIOR ART)
FIG. 1 shows a cut-away side perspective view of a conventional steam turbine.

Turning now to the drawings, FIG. 1 shows a cut-away side perspective view of a conventional double flow steam turbine 100. As shown in FIG. 1, steam turbine 100 includes a high-pressure (HP) section 110, an intermediate-pressure (IP) section 120, and a low-pressure (LP) section 140. The steam turbine 100 shown in FIG. 1 has a dual-flow LP section 140, therefore LP section 140 includes a first LP section 142 and a second LP section 144. Steam turbine 100 further includes a crossover pipe 130 between IP section 120 and LP sections 142, 144, and a feed 132 from crossover pipe 130 to LP sections 142, 144. A generator (not shown) can be connected to a drive train 145 extending through HP section 110, IP section 120, and LP section 140.

Steam turbine 100 is referred to as a drum rotor turbine because it includes a drum rotor 150, rotating within each section. Also, steam turbine 100, as shown in FIG. 1, is configured to connect to a condenser (not shown in FIG. 1) through a side exhaust, as will be discussed in more detail herein. As shown in FIG. 1, HP section 110 and IP section 120 have conventional double shell casings, specifically, as shown in FIG. 1, HP section 110 has a double casing 112, and IP section 120 has a double casing 122. In other words, casings 112, 122 each comprise a shell within a shell, with two walls between drum rotor 150 and the exterior of the turbine.

Figure 2:
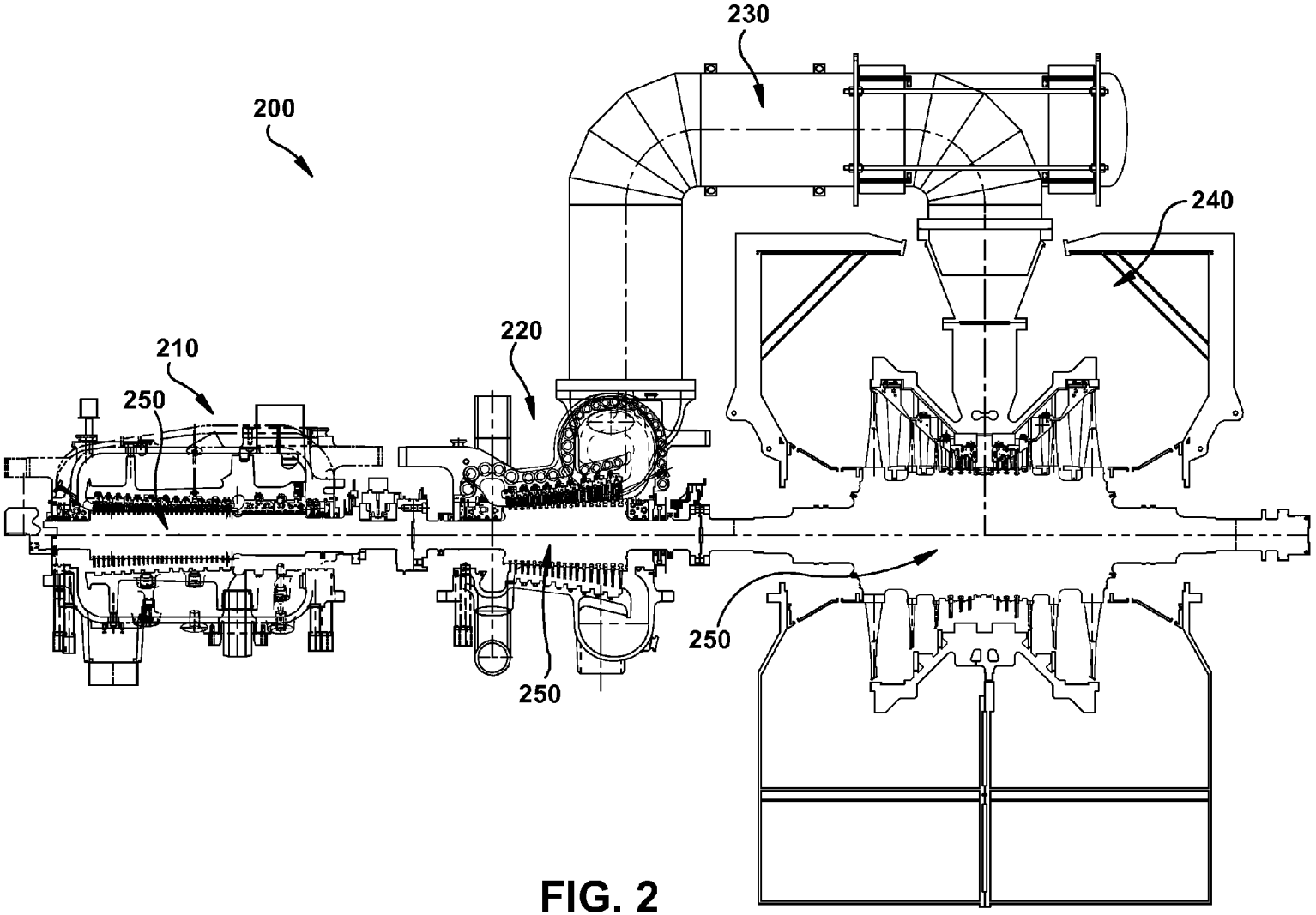
FIG. 2 shows a cross-sectional schematic of a steam turbine according to an embodiment of this invention.
Figure 3:
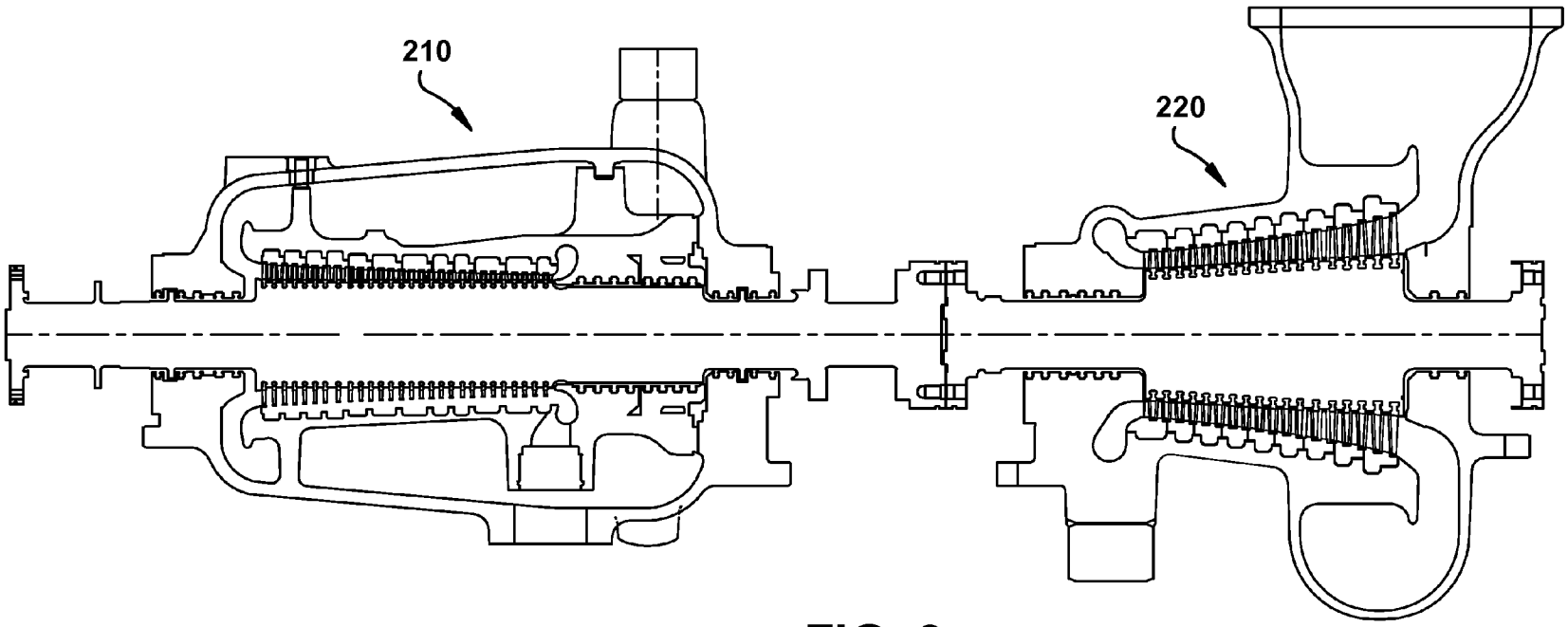
FIG. 3 shows a cross-sectional schematic of a high pressure (HP) section and an intermediate pressure (IP) section of a steam turbine according to an embodiment of this invention.

Turning to FIG. 2, a cross-sectional view of a steam turbine 200 according to an embodiment of this invention is shown. Turbine 200 can include an HP section 210, an IP section 220, an LP section 240, and a crossover pipe 230. Turbine 200 also includes a drum rotor 250 that rotates within sections 210, 220, and 240. In contrast to the conventional steam turbine 100 shown in FIG. 1, turbine 200 includes an HP section 210 having a double shell casing, and an IP section 220 having a single shell casing. A close up view showing HP section 210 and IP section 220 is provided in FIG. 3 in order to better illustrate the different casings in the two sections. In addition, a close up cross-sectional view of HP section 210 is shown in FIG. 4, and a close up cross-sectional view of IP section 220 is shown in FIG. 5.

Figure 4:
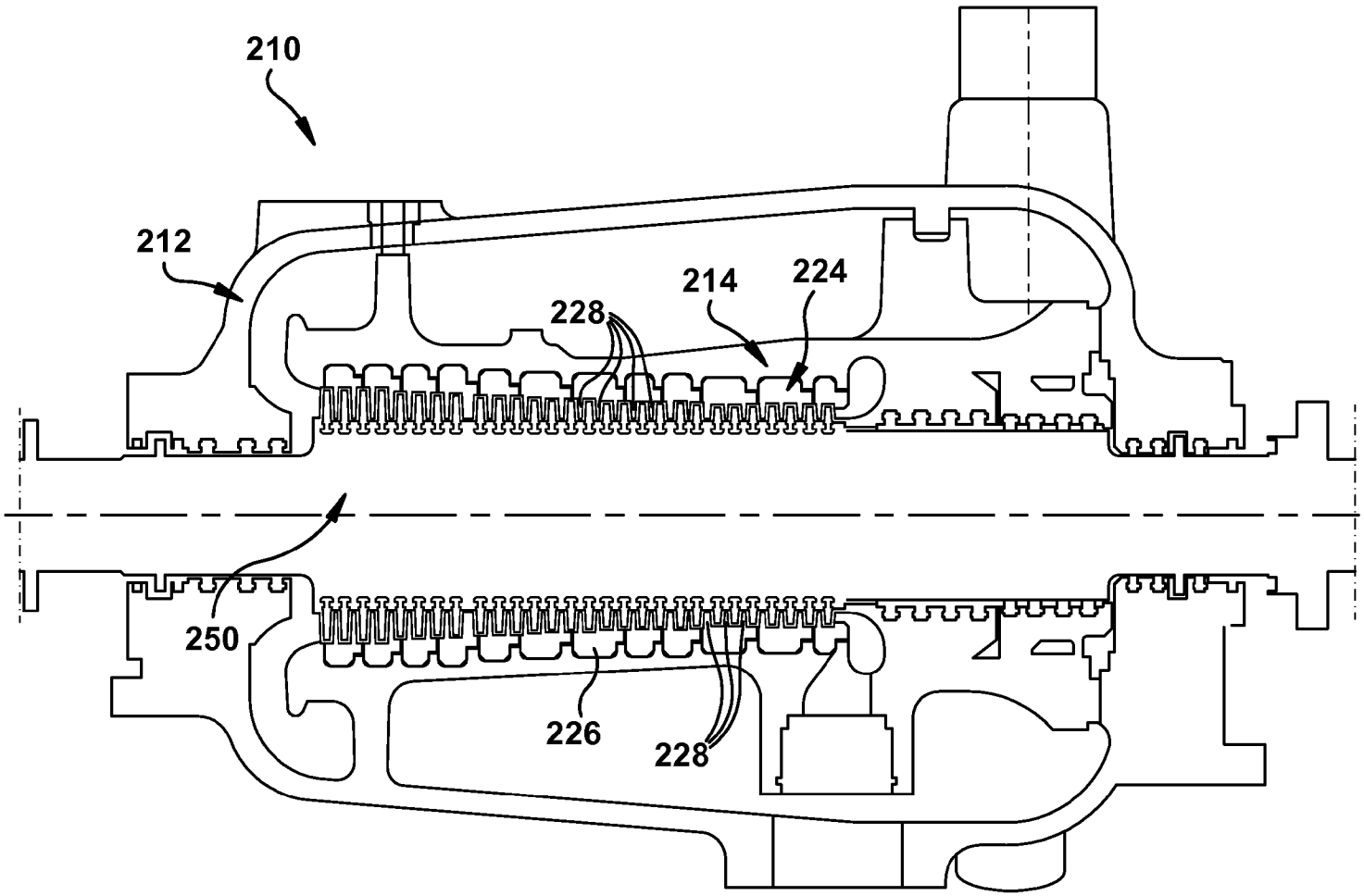
FIG. 4 shows a cross-sectional schematic of a HP section of a steam turbine according to an embodiment of this invention.

As FIG. 4 shows, HP section 210 includes a conventional double shell casing, specifically an outer shell 212 and an inner shell 214. As such, there are two walls or shells, i.e. outer shell 212 and inner shell 214, between drum rotor 250 and the exterior of the turbine. As shown in FIG. 5, in contrast, IP section 220 has a single shell casing 222. In other words, there is only one wall or shell, i.e. inner shell casing 222, between drum rotor 250 and the exterior of the turbine.

Figure 5:
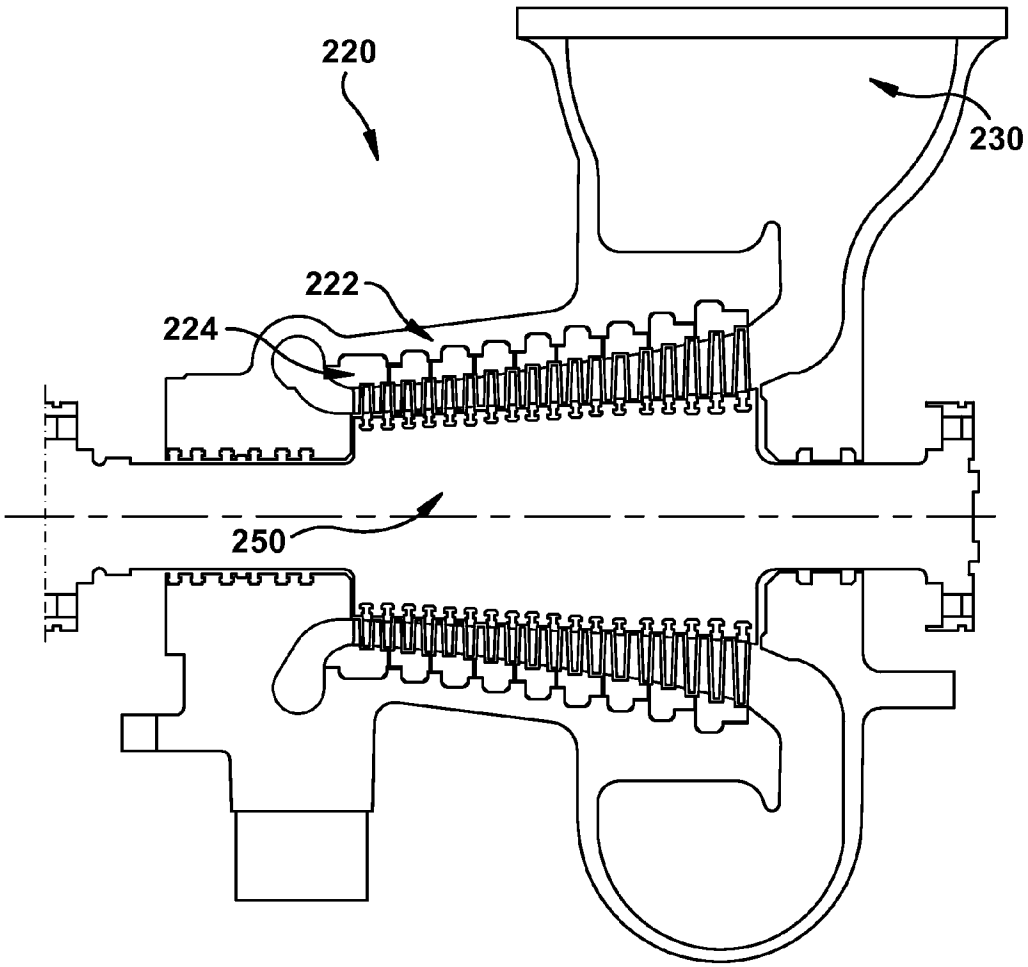
FIG. 5 shows a cross-sectional schematic of an IP section of a steam turbine according to an embodiment of this invention.

As shown most clearly in FIGS. 4 and 5, HP section 210 and IP section 220 also include a plurality of sets of individual nozzles formed in the shape of a ring, e.g., nozzle ring assemblies 224, positioned such that each nozzle ring assembly 224 surrounds drum rotor 250. These nozzle ring assemblies 224 can be axially spaced along single shell casing 222, for example, by being positioned in grooves in casings 214, 222, and can comprise similar type material as drum rotor 250. Nozzle ring assemblies 224 can be fitted to drum rotor 250 thereby minimizing clearances to improve steam path performance.

Figure 6:
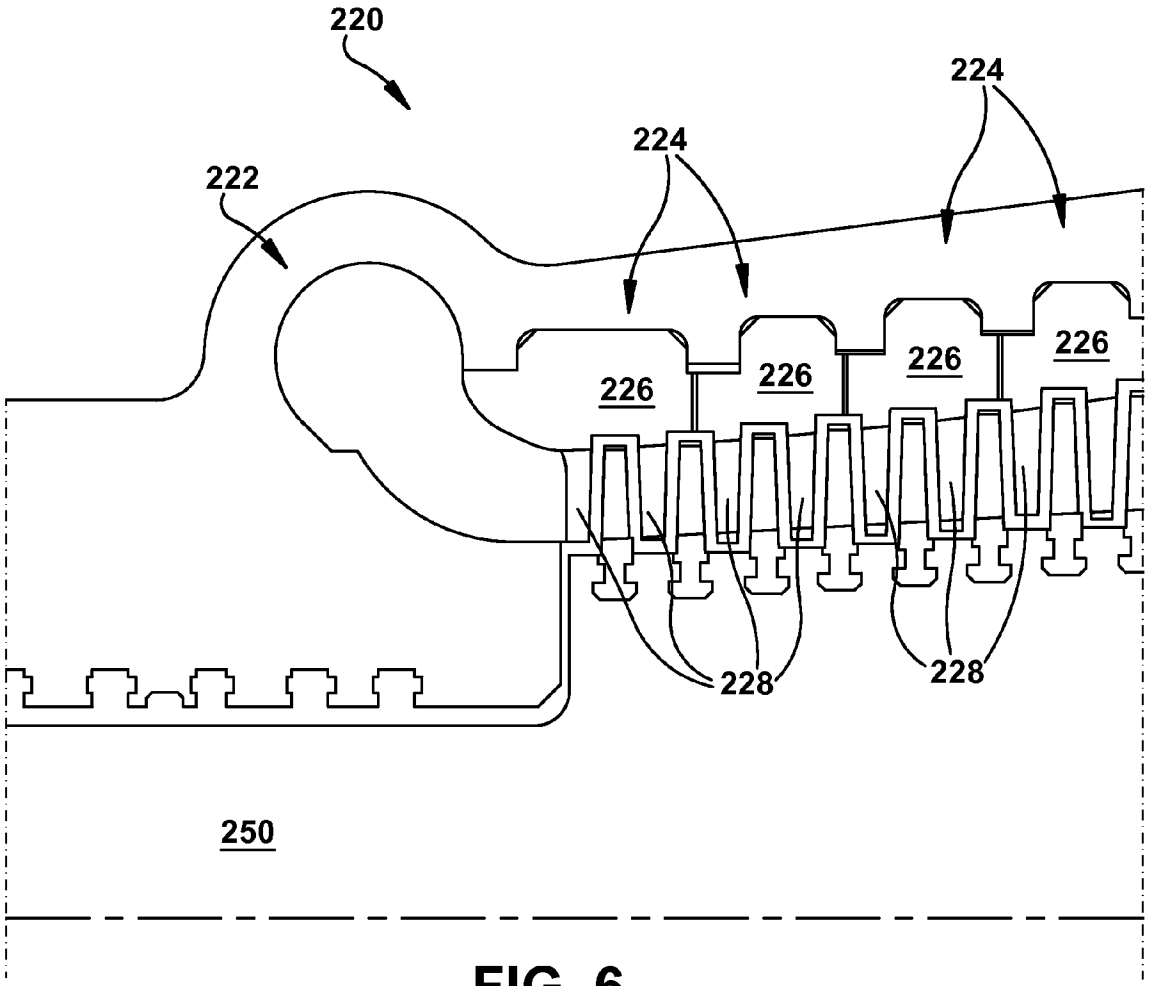
FIG. 6 shows a cross-sectional schematic of an IP section of a steam turbine showing a plurality of nozzle ring assemblies according to an embodiment of this invention.

A close up cross-sectional view of a plurality of nozzle ring assemblies 224 positioned in IP section 220 is shown in FIG. 6. As shown in FIG. 6, each individual nozzle ring assembly 224 includes a supporting ring 226 for supporting at least one set of corresponding nozzles 228. Each set of nozzles 228 can be coupled to supporting ring 226 by a variety of means, for example, nozzles 228 can be slid into grooves in ring 226, or other mechanical means for coupling can be used. While a cross-sectional view is shown in FIG. 6, it will be understood by one having skill in the art that each set of nozzles 228 comprises individual nozzles circumferentially positioned around drum rotor 250. In FIG. 6, there are four nozzle ring assemblies 224 shown, each including one supporting ring 226, and with each supporting ring 226 supporting two sets of nozzles 228. However, it is understood that any desired number of supporting rings 226 and nozzles 228 can be used. For example, as can be seen in FIG. 4, three sets of nozzles 228 can be included in each supporting ring 226.

Figure 7:
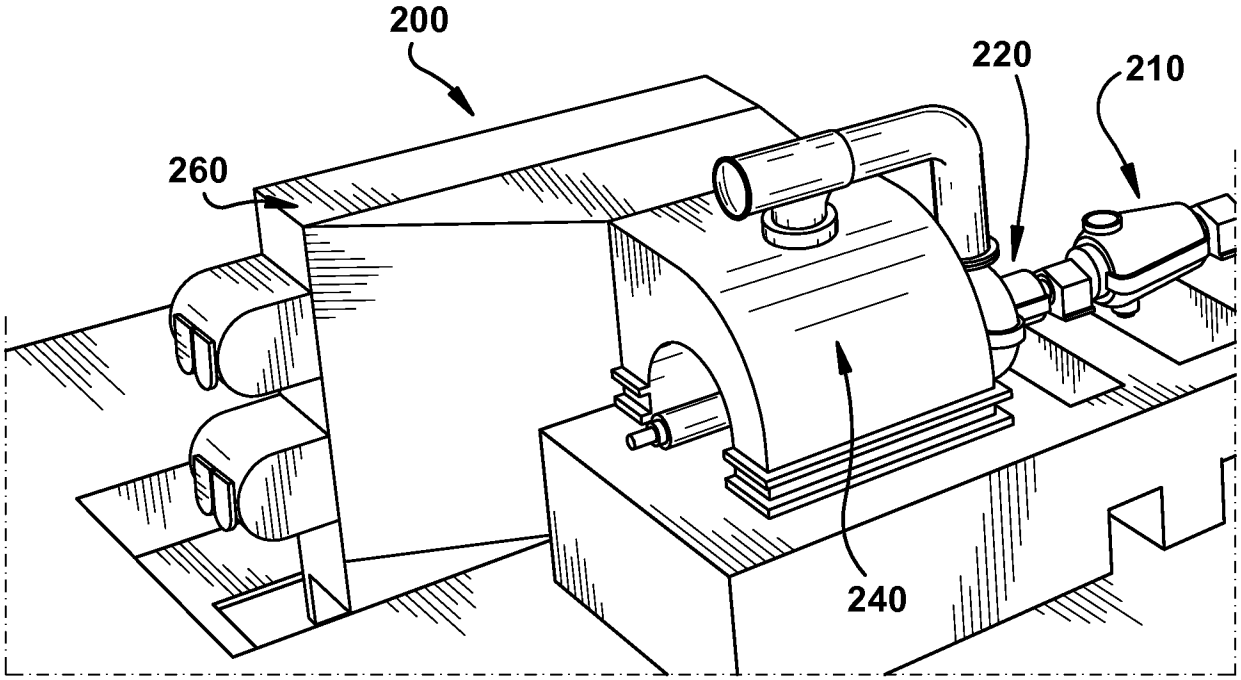
FIG. 7 shows an isometric view of a portion of steam turbine according to an embodiment of this invention including a side exhaust connection to a condenser.
Figure 8:
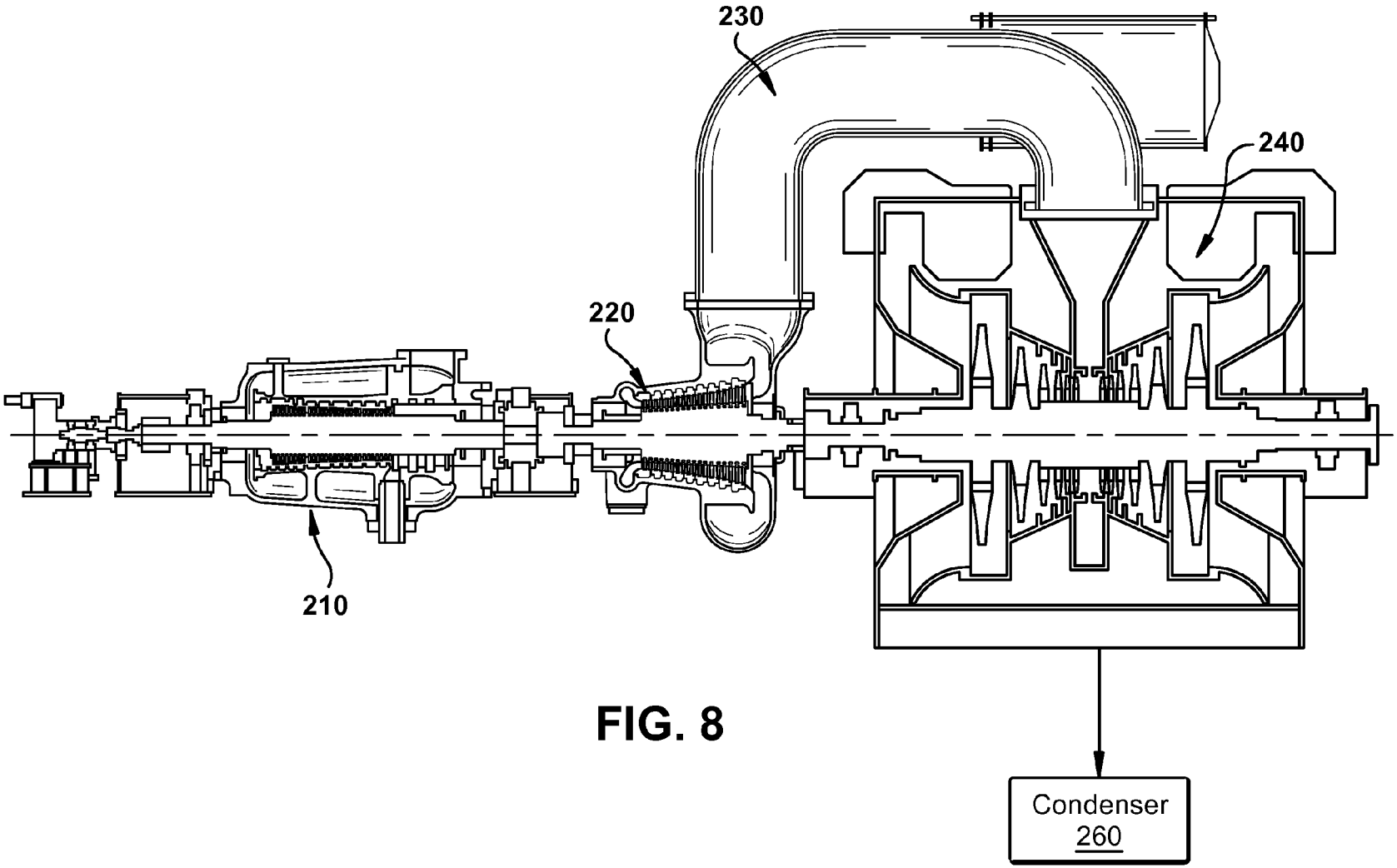
FIG. 8 shows a cross-sectional view of a steam turbine including a downward exhaust connection to a condenser according to an embodiment of this invention.
Figure 9:
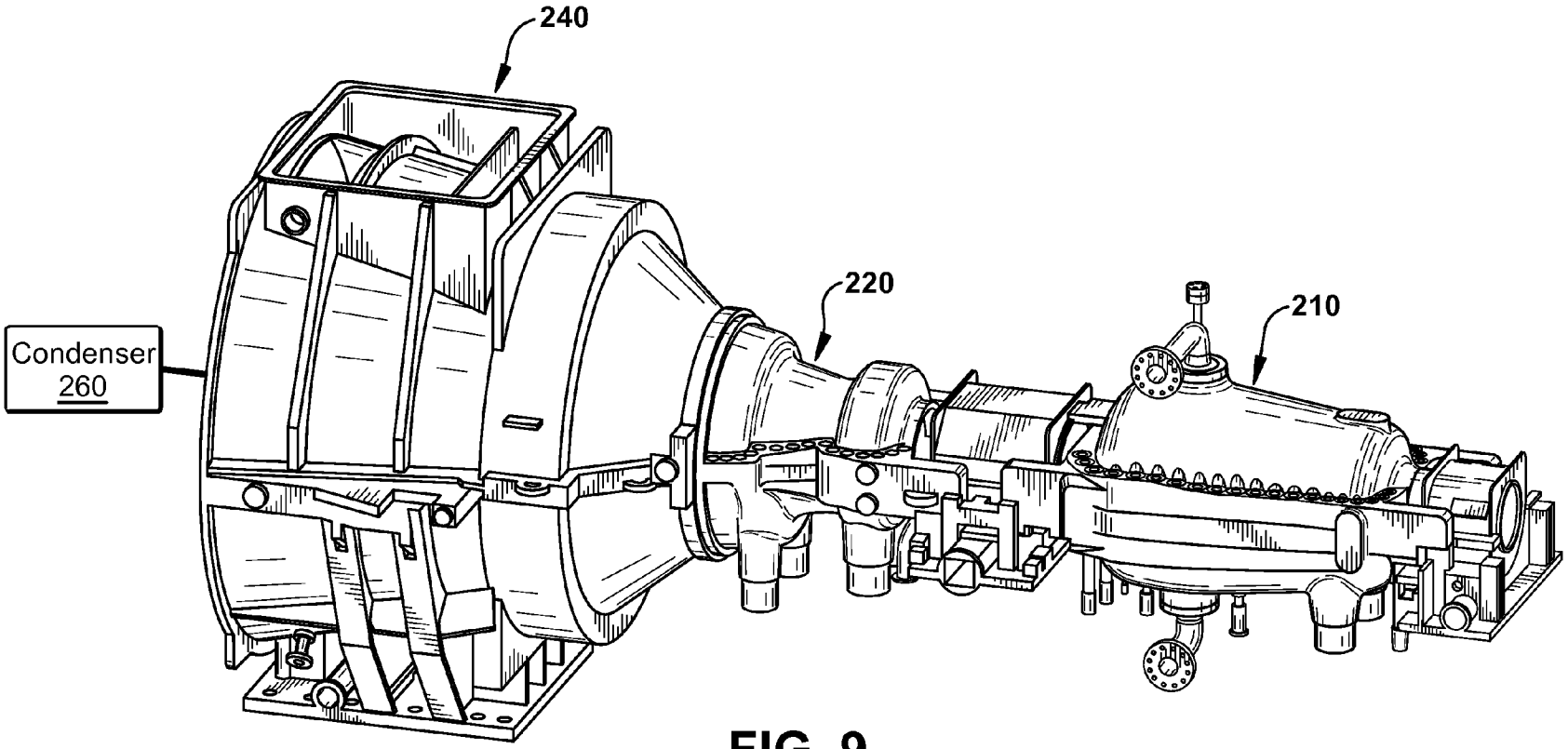
FIG. 9 shows an isometric view of a steam turbine including an axial exhaust connection to a condenser according to an embodiment of this invention.

Turning to FIGS. 7-9, as will be understood by one having skill in the art, it is desired to connect LP section 240 to a condenser 260. The type of connection to condenser 260 can be based on the flow thru the steam turbine and the condenser pressure. In one embodiment, the connection can comprise a side exhaust connection via a transition duct to the condenser, as shown in FIG. 7. In this embodiment, condenser 260 is positioned to the side of LP section 240, rather than above or below LP section 240. In another embodiment, the connection can comprise a downward connection, as shown in FIG. 8. In this embodiment, condenser 260 is positioned vertically below LP section 240 such that the exhaust is expelled downward from LP section 240 to condenser 260. In another embodiment, the connection comprises an axial connection, as shown in FIG. 9. In the example shown in FIG. 9, LP section 240 comprises a single-flow LP section and condenser 260 is axially aligned with LP section 240. In this example, a turbine could be positioned such that LP section 240 could be ducted outside a building into a condenser outside.

Embodiments of this invention include a steam turbine with an HP section that uses the conventional double shell drum design, and an IP section that uses a single casing drum design. The relatively low pressure typical of an IP turbine section (relative to the HP section) allows the use of a single shell configuration. The single shell drum construction in the IP section enables high performance while reducing aspects of IP product cost (e.g., material, construction, installation, etc.). The addition of the nozzle ring assemblies, with individual alignment of the nozzles to the drum rotor further reduces the radial clearance and improves performance of the turbine. In contrast, the conventional configuration, with a two shell casing in both the HP and IP sections, only permits an average alignment of all stages to the rotor, and thereby provides sub-optimal radial clearance. As also shown in FIG. 9, for single-shaft plants (i.e., a steam turbine on the same shaft with other prime movers), the torque generated by the steam turbine can be transmitted to the rest of the power train via a clutch located at the HP end of the turbine, or for multi-shaft applications (i.e., a steam turbine as the only prime mover on the shaft), a solid coupling can be used between the steam turbine and the generator.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any related or incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A steam turbine comprising:

a high pressure (HP) section having a double shell casing, wherein the double shell casing includes an outer shell and an inner shell disposed about the HP section;

an intermediate pressure (IP) section fluidly connected to the HP section, the IP section having a single shell casing, wherein the IP section includes:

a drum rotor; and a plurality of nozzle ring assemblies axially spaced along the single shell casing, such that each nozzle ring assembly surrounds the drum rotor, and wherein each nozzle ring assembly includes:

a supporting ring; and at least one set of individual nozzles coupled to the supporting ring.

2. The steam turbine of claim 1, further comprising a low pressure (LP) section fluidly connected to the IP section, wherein the LP section is also connected to a condenser.

3. The steam turbine of claim 2, wherein the condenser is positioned along side the LP section such that the condenser and the LP section are vertically aligned, and the condenser is connected to the LP section via a transition duct.

4. The steam turbine of claim 2, wherein the condenser is positioned vertically below the LP section.

5. The steam turbine of claim 2, wherein the condenser is axially aligned with the LP section.

6. The steam turbine of claim 1, wherein each nozzle ring assembly in the IP section includes two sets of individual nozzles.

7. The steam turbine of claim 1, wherein each nozzle ring assembly is fitted into a groove in the single shell casing.

8. A steam turbine comprising:

a high pressure (HP) section having a double shell casing, wherein the double shell casing includes an outer shell and an inner shell disposed about the HP section;

an intermediate pressure (IP) section fluidly connected to the HP section, wherein the IP section has a single shell casing, and wherein the IP section includes:

a plurality of nozzle ring assemblies axially spaced along the single shell casing, such that each nozzle ring assembly surrounds the drum rotor, and wherein each nozzle ring assembly includes:

a supporting ring; and at least one set of individual nozzles coupled to the supporting ring;

a low pressure (LP) section fluidly connected to the IP section, wherein the LP section is also connected to a condenser; and a drum rotor disposed within the HP section, the IP section, and the LP section.

9. The steam turbine of claim 8, wherein each nozzle ring assembly in the IP section includes two sets of individual nozzles.

10. The steam turbine of claim 8, wherein each nozzle ring assembly is fitted into a groove in the single shell casing.

11. The steam turbine of claim 8, wherein the condenser is positioned along side the LP section such that the condenser and the LP section are vertically aligned, and the condenser is connected to the LP section via a transition duct.

12. The steam turbine of claim 8, wherein the condenser is positioned vertically below the LP section.

13. The steam turbine of claim 8, wherein the condenser is axially aligned with the LP section.

* * * * *